US008448577B2

(12) United States Patent
Coester

(10) Patent No.: US 8,448,577 B2
(45) Date of Patent: May 28, 2013

(54) ELEVATED TRACK FOR A VEHICLE WITH A PNEUMATIC PROPULSION SYSTEM

(76) Inventor: Oskar Hans Wolfgang Coester, Porto Alegre (BR)

( * ) Notice: Subject to any disclaimer, the term of this patent is extended or adjusted under 35 U.S.C. 154(b) by 251 days.

(21) Appl. No.: 12/990,852

(22) PCT Filed: May 5, 2009

(86) PCT No.: PCT/BR2009/000129
§ 371 (c)(1),
(2), (4) Date: Nov. 3, 2010

(87) PCT Pub. No.: WO2009/135280

PCT Pub. Date: Nov. 12, 2009

(65) Prior Publication Data

US 2011/0056405 A1 Mar. 10, 2011

(30) Foreign Application Priority Data

May 6, 2008 (BR) ..... 0801389

(51) Int. Cl.
*B61B 12/04* (2006.01)

(52) U.S. Cl.
USPC ..... 104/124; 104/155

(58) Field of Classification Search
USPC ..... 104/124, 155, 156
See application file for complete search history.

(56) References Cited

U.S. PATENT DOCUMENTS

| | | | | |
|---|---|---|---|---|
| 3,859,925 | A * | 1/1975 | Hartz | 104/139 |
| 4,142,468 | A * | 3/1979 | Birnstiel | 104/124 |
| 4,587,906 | A * | 5/1986 | Coester | 104/156 |
| 4,658,732 | A * | 4/1987 | Coester | 104/156 |
| 4,774,891 | A * | 10/1988 | Coester | 104/130.01 |
| 5,845,582 | A * | 12/1998 | Coester et al. | 104/156 |
| 6,076,469 | A * | 6/2000 | Coester | 104/155 |
| 2011/0056405 | A1 * | 3/2011 | Coester | 104/124 |

FOREIGN PATENT DOCUMENTS

| | | |
|---|---|---|
| BR | PI 7703372-8 | 12/1978 |
| BR | PI 7906255-5 | 8/1980 |

(Continued)

OTHER PUBLICATIONS

International Search Report dated Sep. 1, 2009, issued in corresponding international application No. PCT/BR2009/000129.

*Primary Examiner* — Jason C Smith
(74) *Attorney, Agent, or Firm* — Ostrolenk Faber LLP

(57) ABSTRACT

The present disclosure refers to an elevated track to support and serve the pneumatic propulsion duct for transportation vehicles, for cargo or passengers. The improved elevated track is modular and self supporting and consists of a pneumatic propulsion central duct (1) on whose vertical walls (11) are fastened side walkways (2). The propulsion duct (1) has structural reinforcing (12) in the form of transverse frames on the duct axis. The side walkways (2) have transverse reinforcement (21) which unify with the duct reinforcing frames (12). On the propulsion duct (1) top edges (13) are fastened rails (3) in an "I" beam format, traditionally used on railroads. A preferred transverse section of the propulsion duct (1) is rectangular, this having a central slot (14) on the top surface (13) for the passage of the vehicle propulsion system. Preferably, the side walkways (2) have protective handrails (4) and edges curved downwards (22) which with the central duct (1) define a covered area to shelter the pedestrians. One constructive option for the elevated track, formed with the propulsion duct (1) and the side walkways (2), which can be supported on pillars (5) positioned under the side walkways (2). In another constructive option, the elevated track can be suspended by vertical tie rods (6) fastened on the side walkways (2).

10 Claims, 6 Drawing Sheets

FOREIGN PATENT DOCUMENTS

| | | |
|---|---|---|
| BR | PI 8301706-2 | 11/1984 |
| BR | PI 8503504-1 | 9/1986 |
| BR | PI 9502056-0 | 8/1997 |
| GB | 1600937 A | 10/1981 |

* cited by examiner

ELEVATED TRACK FOR A VEHICLE WITH A PNEUMATIC PROPULSION SYSTEM

CROSS REFERENCE TO RELATED APPLICATIONS

The present application is a 35 U.S.C. §371 National Phase conversion of PCT/BR2009/000129, filed May 5, 2009, which claims benefit of Brazilian Application No. PI 08001289-6, filed May 6, 2008, the disclosure of which is incorporated herein by reference. The PCT International Application was published in the English language.

BACKGROUND OF THE INVENTION

This invention refers to developed improvement of an elevated track, to support and serve as a duct for a pneumatic propulsion system for transportation vehicles, for cargo or passengers.

The patent BR PI 7703372-8, requested by the same inventor in May 25, 1977, describes an elevated track to support and pneumatically propel a transportation vehicle, the ends of that track being supported on pillars. The track is built of reinforced concrete and has a hollow transversal section with an upper slot for the passage of a vertical rod originating from the transportation vehicle.

The patents BR PI 8301706-2, BR PI 8503504-1 and BR PI 9502056-0, requested by the same inventor in Apr. 4, 1983, Jul. 19, 1985 and May 11, 1995, respectively, describe an elevated track built in reinforced concrete which have the same general concept described in the earlier document.

This track when produced in reinforced concrete has a high implementation cost, especially because of the need for deep foundations. Due to the heavy weight of the concrete track its construction is slow and demands high capacity lifting equipment, even when using tracks made of precast, pre-stressed concrete. Due to these factors the project and transportation line construction offers little flexibility.

On the other hand, the patent BR PI 7906255-5, requested by the same inventor in Sep. 28, 1979, describes a track built of steel plate in a rectangular section tube shape with an upper slot, which is called the propulsion duct. This duct has joining flanges and reinforced at regular intervals, through where the track is supported on sustaining pillars. The vehicle moves using wheels with a special format which roll on a pair of cylindrical rails. The rails are farther apart than the duct width, being in balance and being fastened through the supports joined to the flanges and to the propulsion duct.

Due to its shape, conception and construction the metallic track has the following disadvantages:

- it has a fragile aspect, because the propulsion duct is narrow and the vehicle wheels are supported on balancing rails which are fastened to spaced supports;
- it has a small distance between the pillars, because the duct has a low rigidity and the vehicle has a heavy weight when loaded;
- it needs a side protective structure, not foreseen in the earlier track;
- it needs a side structure to access the track, for maintenance or passenger evacuation of the vehicle when it breaks down between stations, not foreseen in the earlier track.

SUMMARY OF THE INVENTION

Therefore, the object of this invention is an improved elevated track, to support and serve as a duct for a pneumatic propulsion system for transportation vehicles, which overcomes the referred limitations in the prior art concept. The invention proposes an innovative elevated track, modular and self supporting, which consists of a pneumatic propulsion central duct with a rectangular transversal section and with a upper central slot, on whose vertical walls of the propulsion duct are fastened side walkways with handrails for protection. The edges of the walkways are curved downwards, which together with the central duct, define a covered area to shelter the pedestrians. On the edges at the top of the propulsion duct are fastened rails in the form of a "I" beam, traditionally used on railroads.

The elevated track can be supported by pillars positioned under the side walkways. Alternatively, the elevated track can be suspended by vertical tie rods fastened on the side walkways.

Optionally, the rails can be isolated from the propulsion duct top surface by a layer of material with shock absorbing properties, for example, elastomer, for the purpose of reducing vibrations and noise as the vehicle moves.

As another option, the propulsion duct can be formed from a reinforced metallic structure, with its walls closed with a composite laminar material, preferably, a polymer material with fibers, such as fiber glass reinforced polyester (FGRP).

The improved elevated track for the pneumatic propulsion transportation vehicle, proposed in this invention, results in the following advantages over the tracks in the prior art concept.

- it is modular and self supporting;
- it has a low weight and high resistance, due to the casing form where the propulsion duct and walkways are;
- it results in a great implementation flexibility;
- it makes for easy transportation, mounting and maintenance;
- it has side walkways for the access of safety, operational and maintenance people. The walkways are also used to evacuate passengers, if a vehicle breaks down far from the stations;
- it has a covered area which shelters pedestrians from the bad weather;
- it uses "I" beam shaped rails, the same as used on a railroad;
- the vehicle propulsion duct, placed centrally on the track can be made of polymer fiber material and reinforced with an external metallic structure, in this way reducing the track weight without compromising the performance and durability of the duct.

The improved elevated track for the pneumatic propulsion transportation vehicle, object of this invention, can be better understood through the following detailed description, which is based on the drawings in the annex, listed below, which illustrate a preferred form for realization, shown with merely the intention of giving an example and it should not be considered as limiting the invention:

DESCRIPTION OF PREFERRED EMBODIMENTS

Figure 1:
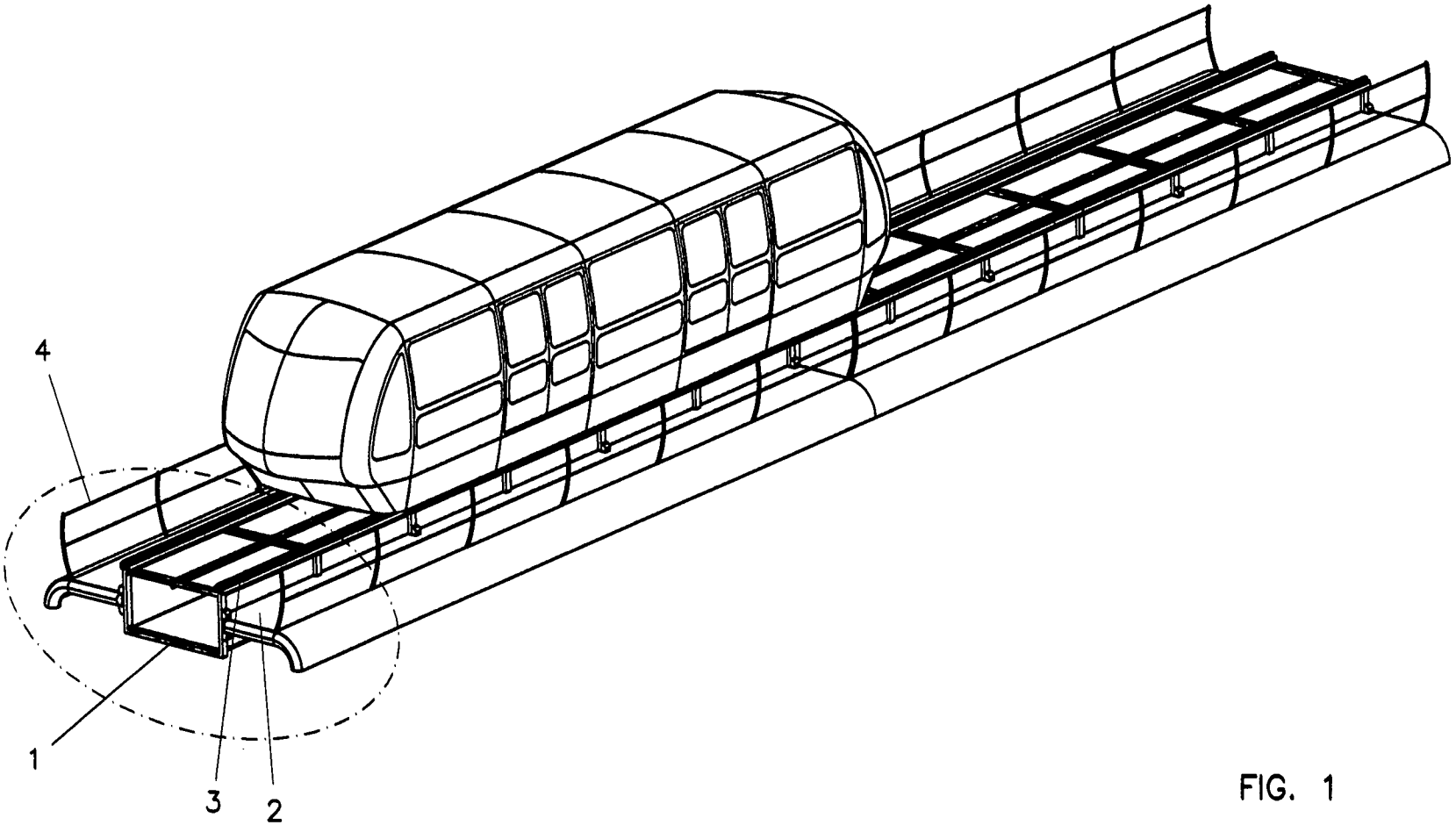
FIG. 1—elevated track view.
Figure 2:
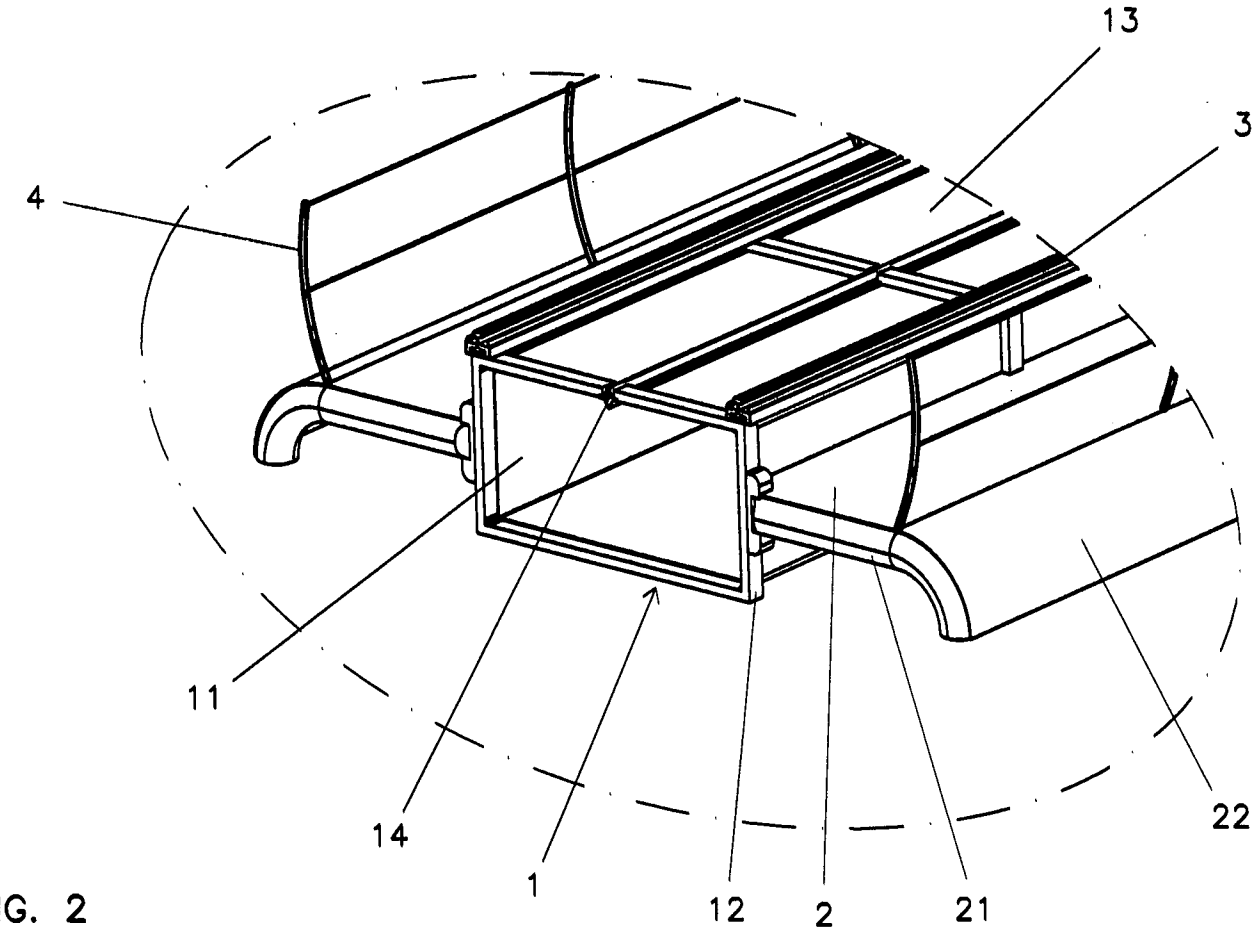
FIG. 2—elevated track detailed perspective view.

FIGS. 1 and 2 illustrate in a general form the improved elevated track, modular and self supporting, which consists of a pneumatic propulsion central duct (1) on whose vertical sides (11) are fastened side walkways (2). The propulsion duct (1) has reinforced structures (12) in the form of frames transversal to the duct axis. The side walkways (2) have transverse reinforcing (21) which unify with the duct reinforcing frames (12). On the edges of the propulsion duct top (13) the rails are fastened (3) in an "I" beam format traditionally used by railroads.

A preferred propulsion duct transversal section (1) is rectangular, having a central slot (14) on the top surface (13) for the passage of the vehicle propulsion system.

Preferably, the side walkways (2) have protective handrails (4) and edges which curve downwards (22) which together with the central duct (1), define a covered area to shelter pedestrians.

Figure 3:
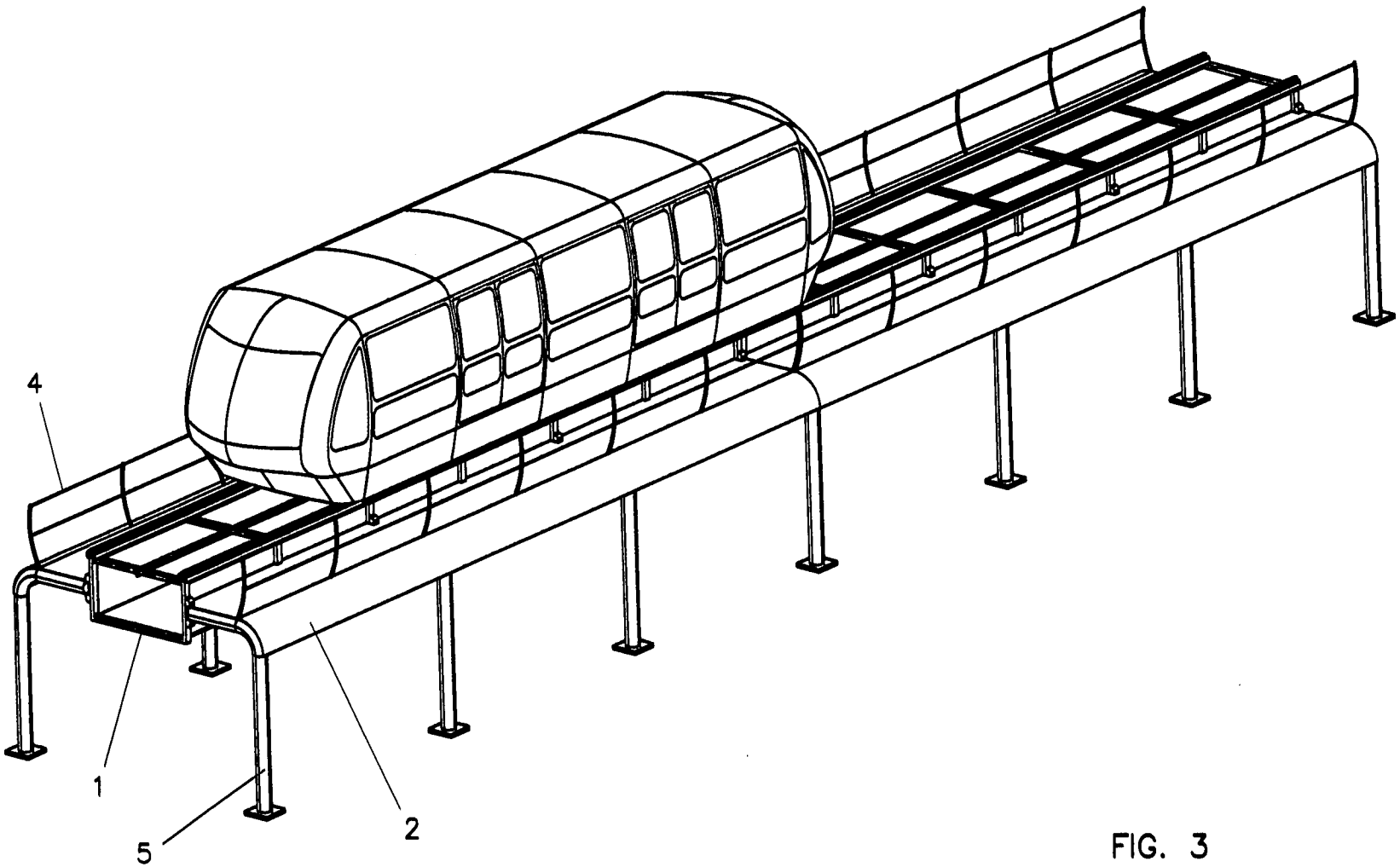
FIG. 3—elevated track suspended version perspective view.

FIG. 3 illustrates a constructive option for the elevated track, by putting together the propulsion duct (1) and the side walkways (2), which can be supported by pillars (5) positioned under the side walkways (2).

Figure 4:
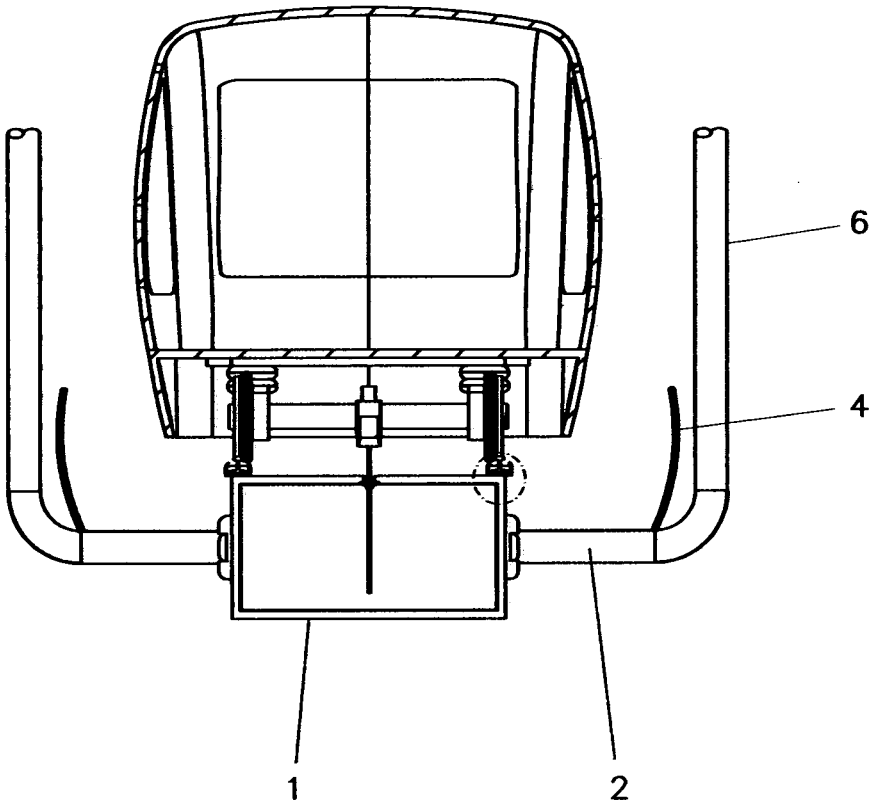
FIG. 4—suspended version of the track front cross section view.

FIG. 4 illustrates a constructive option of the elevated track, by putting together the propulsion duct (1) and the side walkways (2), these can be suspended by vertical tie rods (6) fastened on the side walkways (2).

Figure 5:
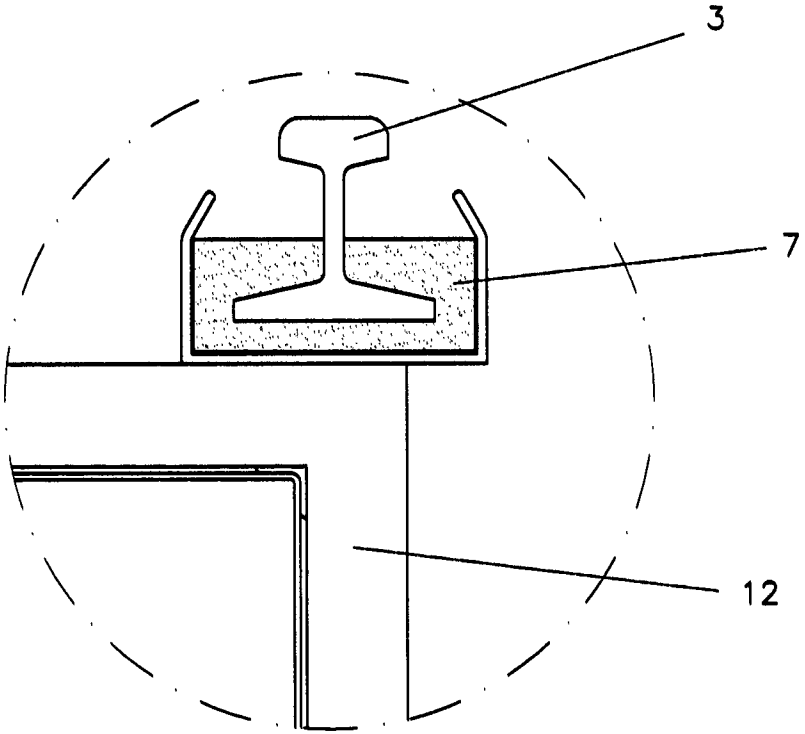
FIG. 5—duct rail support detail front view.

FIG. 5 details another constructive option of the elevated track, whose rails (3) can be isolated from the reinforcing frame (12) of the propulsion duct (1) using a material layer with shock absorbing properties (7), such as elastomer, whose purpose is to reduce vibrations and noise when the vehicle moves.

Figure 6:
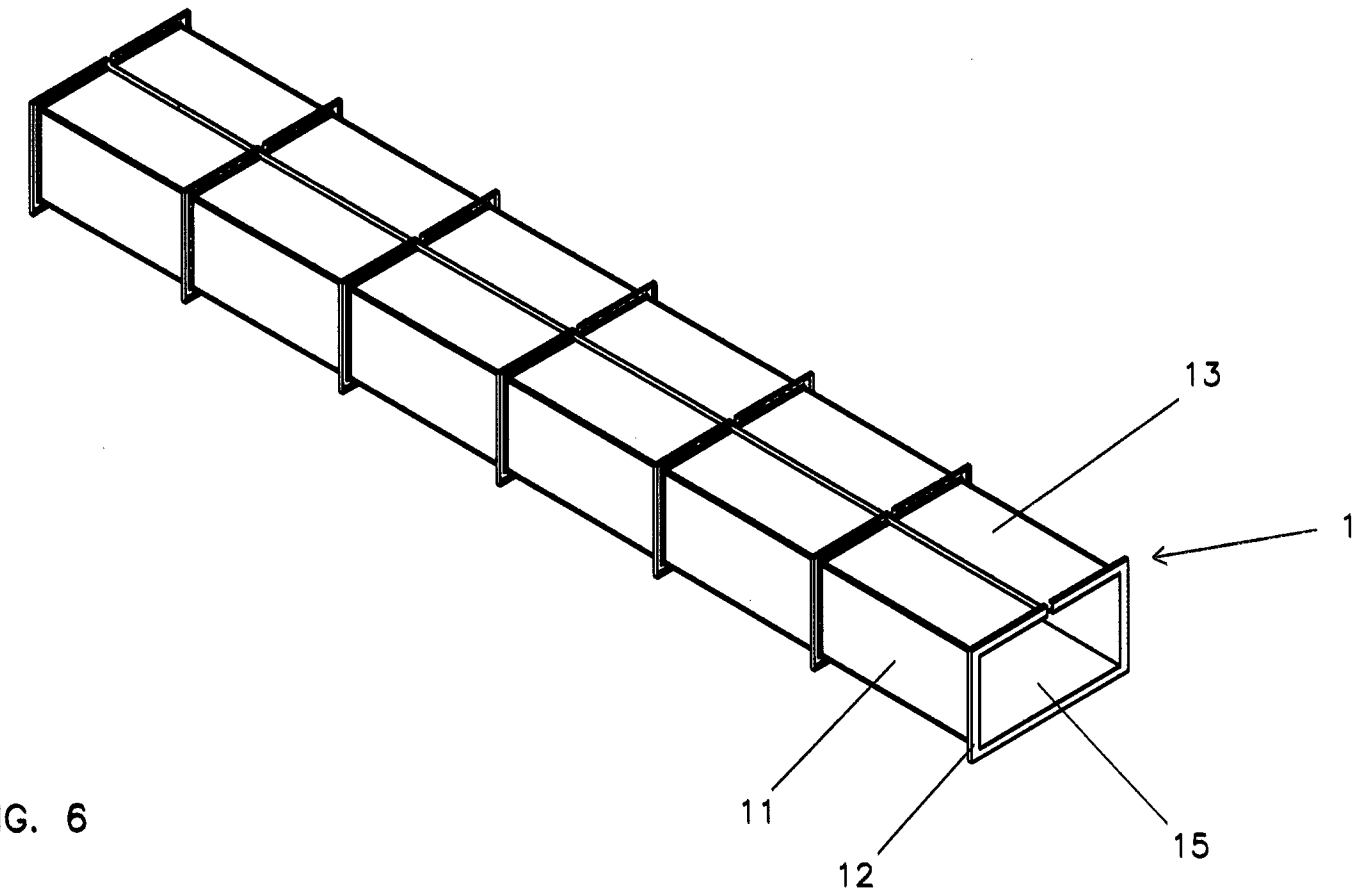
FIG. 6—duct detail perspective view.

FIG. 6 illustrates a preferred way of building the propulsion duct (1), which has a reinforced metallic structure (12). Its side walls (11), top (13) and base (15) are closed by composite laminar material plate, preferably a polymer with fiber material, such as fiber glass reinforced polyester (FGRP).

What is claimed is:

1. An elevated track for a pneumatic propulsion system for a vehicle comprising:

an elongate propulsion duct extending beneath the vehicle in an axial direction in which the vehicle is to be propelled, the duct having spaced apart vertical walls;

a side walkway fastened to the duct and extended outward from the vertical walls sufficiently to provide a space outward of a vehicle on the track for defining the walkway;

transversely extending reinforcements which extend across the duct and are spaced apart in the axial direction;

top edges directly above the duct and extending along the duct and rails for the vehicle at the top edges of the duct; and a slot into the duct for a propulsion device that extends from a vehicle above the duct through the slot into the duct.

2. The vehicle propulsion system of claim 1, wherein the transverse section of the duct is rectangular including a top, a base and the vertical walls between the top and the base.

3. The vehicle propulsion system of claim 1, wherein the slot in the top of the duct is a centrally located slot transversely across the duct for enabling passage of a vehicle propulsion system from the vehicle into the duct.

4. The vehicle propulsions system of claim 1, further comprising protective hand rails on the side walkway; and the walkway having edges laterally outward of the duct which are curved downward.

5. The vehicle propulsion system of claim 1, further comprising a layer of a material with shock absorbing properties disposed between the rails and the propulsion duct.

6. The pneumatic propulsion system of claim 1, wherein the propulsion duct is made of a reinforcing metallic structure comprised of the side walls, top and base and the duct is closed with a composite laminate material.

7. The vehicle propulsion system of claim 1, further comprising pillars under the side walkway for supporting the elevated track.

8. The vehicle propulsion system of claim 1, further comprising vertical tie rods fastened on the side walkways.

9. The vehicle propulsion system of claim 1, wherein the walkway covers and protects an area below itself.

10. The vehicle propulsion system of claim 1, further comprising supporting pillars under the walkway laterally spaced from each other.

* * * * *